US006295737B2

(12) United States Patent
Patton et al.

(10) Patent No.: US 6,295,737 B2
(45) Date of Patent: Oct. 2, 2001

(54) APPARATUS AND METHOD FOR MARKING A CONTOURED SURFACE HAVING COMPLEX TOPOLOGY

(75) Inventors: David L. Patton, Webster; John R. Fredlund, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/761,018

(22) Filed: Jan. 15, 2001

Related U.S. Application Data

(63) Continuation of application No. 09/014,321, filed on Jan. 27, 1998.

(51) Int. Cl.[7] ..... B43L 13/00; B43K 29/08

(52) U.S. Cl. ..... 33/18.1; 33/21.1; 33/26; 33/511; 101/35

(58) Field of Search ..... 33/18.1, 20.1, 33/20.2, 21.1, 21.2, 26, 27.01, 27.12, 32.1, 32.3, 34, DIG. 21, 511, 512, 1 K, 1 BB, 1 CC; 347/2, 4, 106, 107, 1; 101/35; 702/167, 168, 189, FOR 131; 358/1.1, 1.6, 1.18, 1.9

(56) References Cited

U.S. PATENT DOCUMENTS

| | | | | |
|---|---|---|---|---|
| 4,045,397 | | 8/1977 | Parkinson | 524/262 |
| 4,138,686 | | 2/1979 | Graf | 347/74 |
| 4,233,895 | | 11/1980 | Wehler | 101/93.05 |
| 4,409,650 | * | 10/1983 | Noguchi | 700/88 |
| 4,580,914 | | 4/1986 | Rich et al. | 400/56 |
| 4,691,716 | * | 9/1987 | Tanne | 600/587 |
| 4,769,650 | | 9/1988 | Peng et al. | 347/4 |
| 4,796,201 | * | 1/1989 | Wake | 345/430 |
| 4,807,152 | * | 2/1989 | Lane et al. | 700/247 |
| 4,935,616 | | 6/1990 | Scott | 250/214 VT |
| 4,976,036 | * | 12/1990 | Yamanouchi et al. | 33/23.03 |
| 4,999,645 | | 3/1991 | Grattan et al. | 346/140.1 |
| 5,088,046 | * | 2/1992 | McMurty | 700/161 |
| 5,088,055 | * | 2/1992 | Oyama | 702/168 |
| 5,110,615 | * | 5/1992 | Maiorca et al. | 427/8 |
| 5,119,109 | | 6/1992 | Robertson | 347/2 |
| 5,127,037 | * | 6/1992 | Bynum | 378/4 |
| 5,144,330 | | 9/1992 | Bennett | 347/2 |
| 5,255,352 | * | 10/1993 | Falk | 345/425 |
| 5,273,079 | * | 12/1993 | Gross et al. | 134/57 R |
| 5,380,978 | * | 1/1995 | Pryor | 219/121.6 |
| 5,465,037 | * | 11/1995 | Huissoon et al. | 318/568.1 |
| 5,880,759 | | 3/1999 | Silverbrook | 347/55 |
| 5,906,005 | | 5/1999 | Niskala et al. | 2/206 |
| 6,126,270 | | 10/2000 | Lebens et al. | 347/48 |
| 6,135,654 | * | 10/2000 | Jennel | 400/61 |
| 6,212,784 | * | 4/2001 | Pittman | 33/18.1 |

FOREIGN PATENT DOCUMENTS

| | | |
|---|---|---|
| 0 602 251 A1 | 6/1994 | (EP) . |
| 0 931 649 A2 | 7/1999 | (EP) . |

* cited by examiner

*Primary Examiner*—Diego Gutierrez
*Assistant Examiner*—R. Alexander Smith
(74) *Attorney, Agent, or Firm*—Walter S. Stevens

(57) ABSTRACT

Apparatus for marking a contoured surface having complex topology. The apparatus comprises a movable marker for marking the surface and a sensor disposed in sensing relationship to the surface for sensing contour of the surface. A controller interconnecting the marker and the sensor is also provided for actuating the marker and for controllably moving the marker relative to the surface in response to the contour sensed by the sensor, so that the marker follows the contour of the surface at a predetermined distance therefrom and marks the surface.

14 Claims, 8 Drawing Sheets

APPARATUS AND METHOD FOR MARKING A CONTOURED SURFACE HAVING COMPLEX TOPOLOGY

This application is a continuation application of U.S. application Ser. No. 09/014,321 filed Jan. 27, 1998.

BACKGROUND OF THE INVENTION

This invention generally relates to marking apparatus and methods and more particularly relates to an apparatus and method for marking a contoured surface having complex topology.

It is often desirable to place an image on a three-dimensional object having a complex topology, such as a vase or a human bust statue. Usually this image is applied manually, which is timely and costly. Attempting to quickly apply the image manually to the object typically results in less precision in placement of the image on the object, which is an undesirable result. Therefore, it is desirable to provide a marking device capable of marking such a three-dimensional object having complex topology.

Devices for marking curved surfaces are known. One such device is disclosed in U.S. Pat. No. 5,119,109 titled "Method And Apparatus For Marking The Inside Surface Of Pipe" issued Jun. 2, 1992 in the name of John A. Robertson. This patent discloses a system wherein dot matrix characters are formed upon the inside surface of a pipe or other curved surface by an array of ink spray nozzles disposed within a marker head assembly. The marker head is moved by a carriage in a manner such that character pixels are formed during movement of the marker head along loci parallel with the longitudinal axis of the pipe. An indexing mechanism engages an outer surface of the pipe to index it from one marking locus to the next marking locus. Also, a translational mechanism moves the carriage from an off-line to an on-line position during operation of the device. However, this patent does not disclose measuring distance of the surface of the pipe from the marker head before marking begins. That is, this patent does not appear to disclose sensing distance of the surface from the marker head, which may be required in order to sequentially mark pipes having different diameters. Moreover, use of the Robertson device does not appear to assure uniform placement of ink on a contoured surface having complex topology, such as a vase or a human bust statue.

Therefore, there has been a long-felt need to provide an apparatus and method for suitably marking a contoured surface of complex topology in a manner which automatically determines the contour of the surface and quickly, yet precisely, applies a marking medium uniformly to predetermined portions of the surface.

SUMMARY OF THE INVENTION

The present invention resides in an apparatus for marking a contoured surface having complex topology. The apparatus comprises a movable marker for marking the surface and a sensor disposed in sensing relationship to the surface for sensing contour of the surface. A controller interconnecting the marker and the sensor is also provided for actuating the marker and for controllably moving the marker relative to the surface in response to the contour sensed by the sensor, so that the marker follows the contour of the surface at a predetermined distance therefrom and marks the surface.

An object of the present invention is to provide an apparatus and method for marking a contoured surface having complex topology in a manner which automatically determines the contour of the surface and applies a marking medium uniformly to predetermined portions of the surface.

A feature of the present invention is the provision of a sensor for sensing contour of the surface.

Another feature of the present invention is the provision of a controller connected to the sensor for obtaining a three-dimensional map of the surface sensed by the sensor.

An advantage of the present invention is that marking medium is precisely applied evenly on predetermined portions of the surface in a time-saving manner.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

Figure 1:
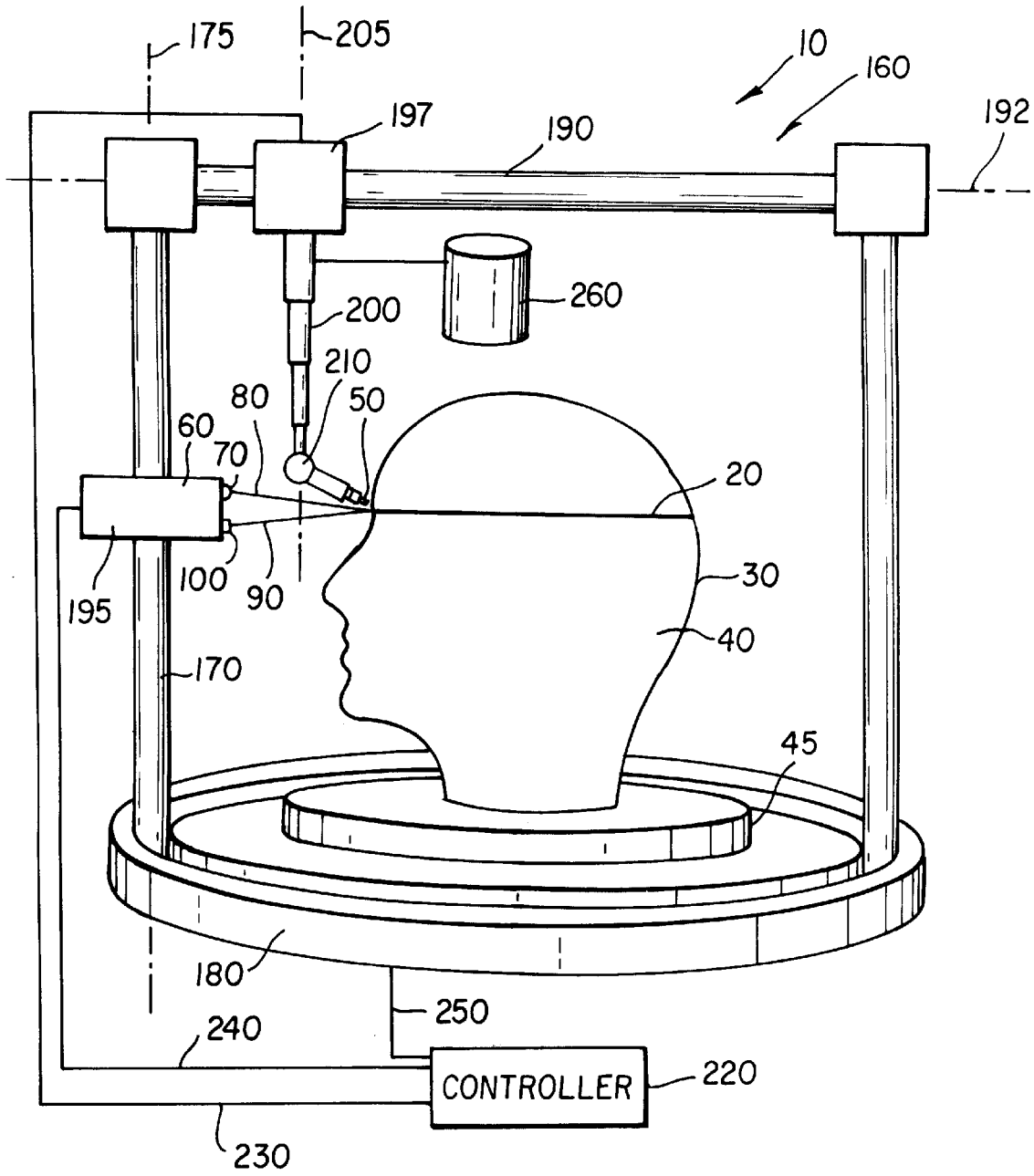
FIG. 1 is a view in elevation of the present invention showing a sensor comprising a laser system for measuring distance of a contoured surface from the sensor.

The present description will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3 and 4, there is shown a first embodiment of the present invention, which is an apparatus, generally referred to as 10, for marking an image 20 on a contoured surface 30 defined by an object 40 resting on a support platform 45. Surface 30 may have a complex (i.e., undulating or curvilinear) topology. Apparatus 10 comprises a movable marker 50, which may be a piezoelectric inkjet printhead of the type disclosed in commonly assigned U.S. patent application Ser. No. 09/017,827, now U.S. Pat. No. 6,126,270, titled "Image Forming System And Method" filed Feb. 3, 1998, in the name of John Lebens, et al., the disclosure of which is hereby incorporated by reference. Alternatively, printhead 50 may be a thermal inkjet printhead of the type disclosed in commonly assigned U.S. patent application Ser. No. 08/750,438 now U.S. Pat. No. 5,880, 759 titled "A Liquid Ink Printing Apparatus And System" filed Dec. 3, 1996, in the name of Kia Silverbrook, the disclosure of which is hereby incorporated by reference.

Referring again to FIGS. 1, 2, 3 and 4, a sensor 60 is disposed in sensing relationship to surface 30 for sensing contour of surface 30. As sensor 60 senses contour of surface 30, the sensor 30 generates a contour map corresponding to the contour of surface 30 sensed thereby, as described more fully hereinbelow. Sensor 60 is preferably a laser system comprising a photodiode light source 70 capable of emitting a laser light beam 80 to be intercepted by surface 30 and reflected therefrom to define a reflected light beam 90. In such a laser system, sensor 30 further comprises a light detector 100, which may be a CCD (Charged Couple Device) associated with light source 70 for detecting reflected light beam 90. In this regard, the laser system comprising light source 70 and detector 100 may be a modified "IMPULSE"™ model laser system available from Laser Technology, Incorporated located in Englewood, Colo. Alternatively, sensor 60 may be a sound producing/detecting system comprising a sonic transducer 110 for emitting an ultra sound wave 120 to be intercepted by surface 30 and reflected therefrom to define a reflected sound wave 130. In such a sound producing/detecting system, sensor 60 further comprises a sonic detector 140 associated with transducer 110 for detecting reflected sound wave 130. In this regard, the sound producing/detecting system comprising sonic transducer 110 and sonic detector 140 may be a "Model 6500"™ sound producing/detecting system available from Polaroid located in Cambridge, Mass. As another alternative, sensor 60 may be a mechanical follower mechanism comprising a telescoping spring-loaded follower 150 having an end portion 155 (e.g., a rollable ball bearing) adapted to contact surface 30 and follow thereal-ong. In this case, telescoping follower 150 is capable of extending and retracting in order to follow contour of surface 30 and is also capable of generating an electrical signal indicative of the amount follower 150 extends and retracts with respect to contour of surface 30. It should be appreciated that sensor 60 and printhead 50 need not be pointing at the same location on surface 30 as long as the initial position of sensor 60 relative to the initial position of printhead 50 is known at the start of the mapping process.

Still referring to FIGS. 1, 2, 3 and 4, a positioning mechanism, generally referred to as 160, is connected to marker 50 and sensor 60 for positioning marker 50 and sensor 60 relative to surface 30. Positioning mechanism 160 comprises at least one elongate leg 170 defining a longitudinal first axis 175 therethrough. Leg 170 also has an end portion thereof connected to a motorized rotatable base 180 which rotates leg 170 in a 360° circle around support platform 45. The other end portion of elongate leg 170 is connected to an elongate beam member 190 defining a longitudinal second axis 192 therethrough disposed orthogonally (i.e., at a 90° angle) to first axis 175. Moreover, positioning mechanism 160 further comprises a motorized first carriage 195 which slidably engages leg 170 and to which sensor 60 is connected, so that sensor 60 is capable of slidably moving along leg 170 in the direction of first axis 175. In addition, positioning mechanism 160 comprises a motorized second carriage 197 which slidably engages beam member 190 and to which printhead 50 is connected, so that printhead 50 is capable of slidably moving along beam member 190 in the direction of second axis 192. More specifically, printhead 50 is connected to a telescoping arm 200 which in turn is connected to beam member 190. Connecting printhead 50 to arm 200 allows distance between printhead 50 and surface 30 to be held constant by adjustment of the amount of extension of arm 200. Maintaining constant distance between printhead 50 and surface 30 allows a marking medium (e.g., colored ink) to be uniformly applied to surface 30. To achieve this result, telescoping arm 200 is capable of telescoping printhead 50 outwardly away from and inwardly towards second carriage 197 along a third axis 205 running longitudinally through telescoping arm 200. Further, a ball-in-socket joint 210 preferably interconnects printhead 50 and arm 200 for moving printhead 50 in a path defined by a lune 215 centered about third axis 205 and circumscribing a 360° circle around arm 200, as best illustrated by dashed lines in FIG. 2. Ball-in-socket joint 210 is movable by means of a linkage (not shown) interconnecting ball-in-socket joint 210 with second carriage 197.

Figure 2:
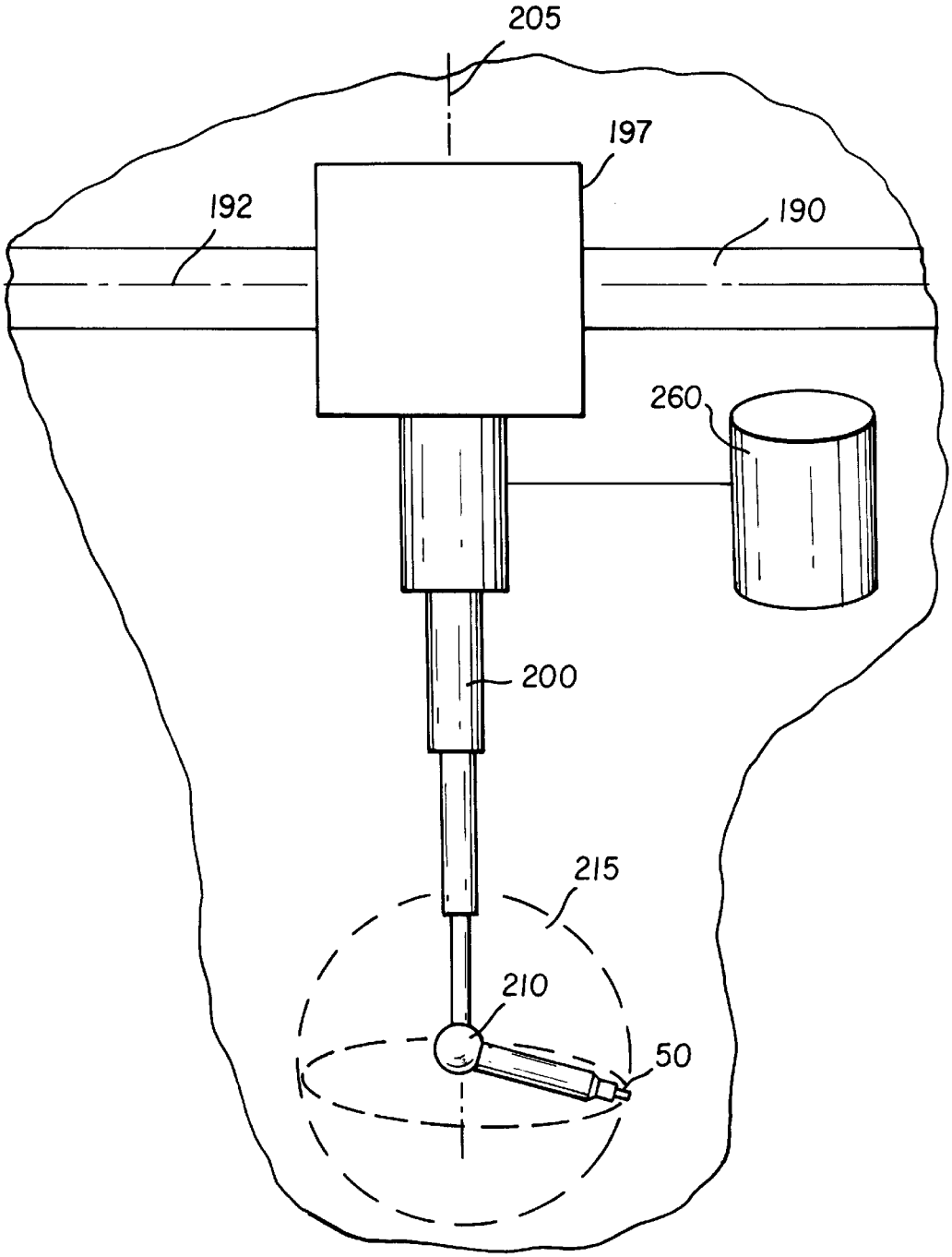
FIG. 2 is a fragmentation view showing a telescoping arm connected to a printhead belonging to the present invention.
Figure 3:
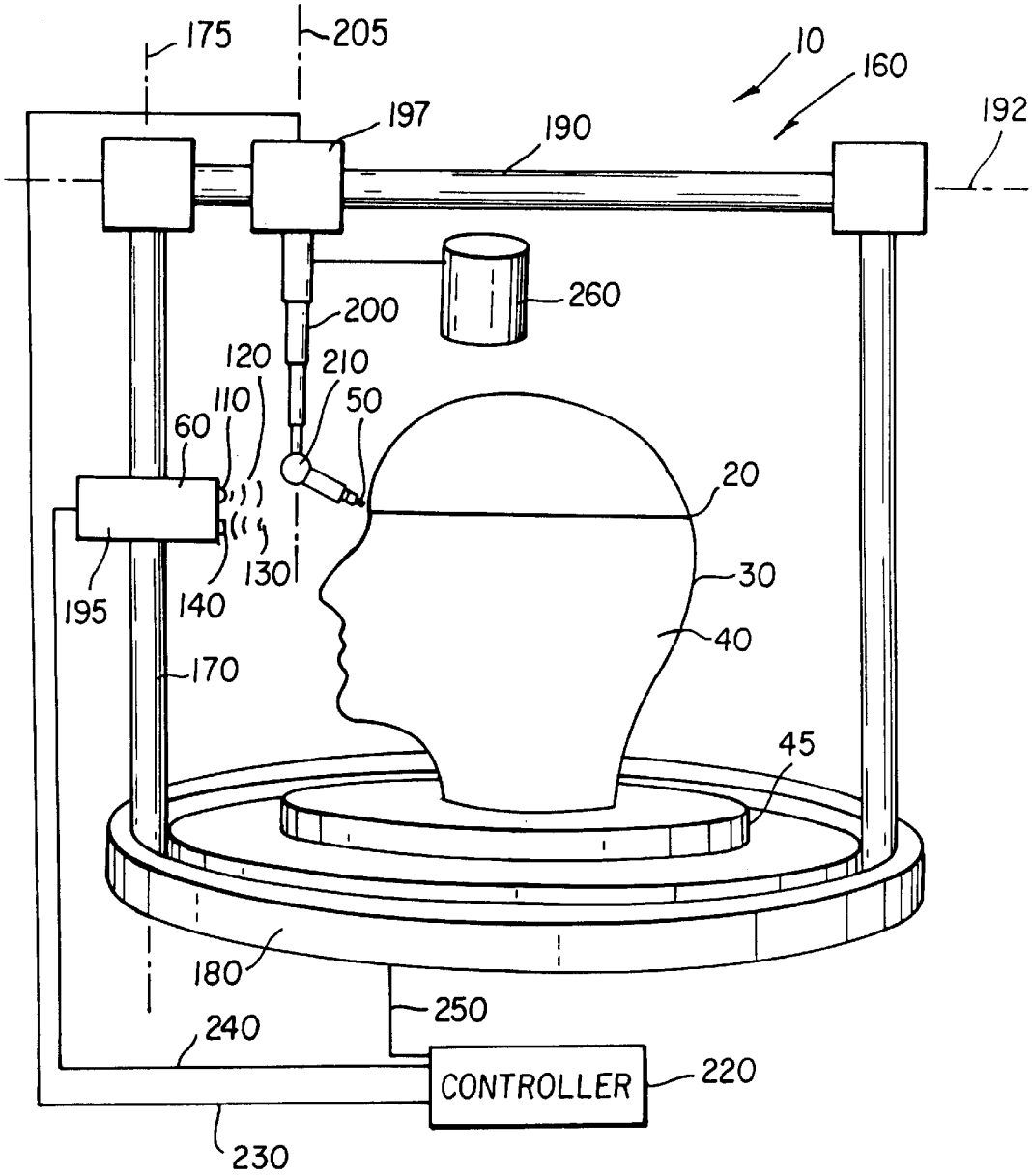
FIG. 3 is a view in elevation of the present invention showing a sensor comprising a ultra sound producing/detecting system for measuring distance of the contoured surface from the sensor.
Figure 4:
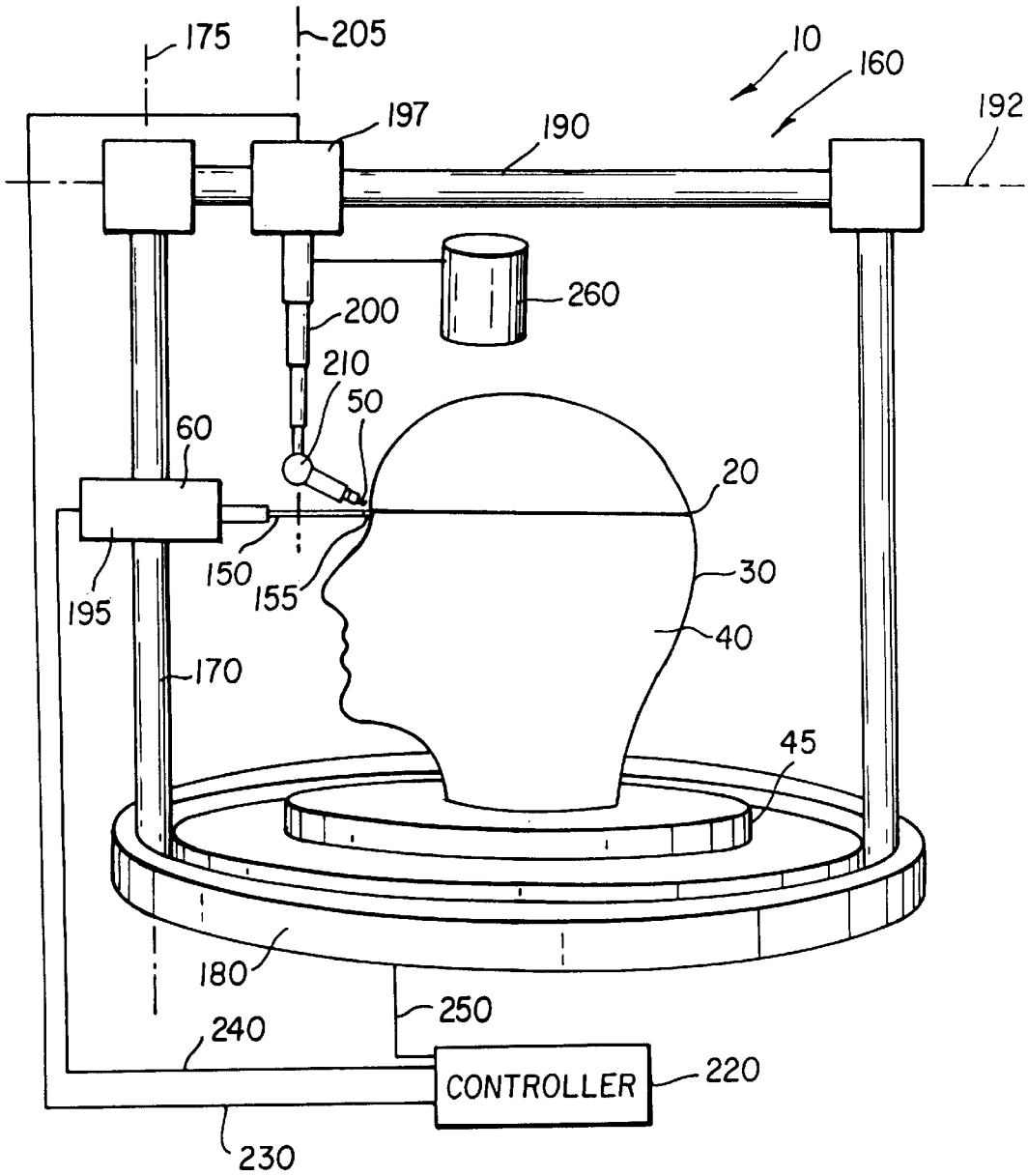
FIG. 4 is a view in elevation of the present invention showing a sensor comprising a mechanical follower for measuring distance of the contoured surface from the sensor.

Referring yet again to FIGS. 1, 2, 3 and 4, it may be appreciated that printhead 50 obtains at least three degrees freedom of movement relative to surface 30 in order to mark substantially any portion of surface 30. That is, printhead 50 is capable of moving around object 40 in a 360° circle to define a first degree freedom of movement because printhead 50 is connected to beam member 190 which in turn is connected to leg 170 that is connected to rotatable base 180. Thus, as rotatable base 180 moves leg 170 in the 360° circle around object 40, printhead 50 will also move to a like extent in a 360° circle around object 40. In addition, printhead 50 is capable of moving in a direction outwardly away from and inwardly towards second carriage 197 along third axis 205 to define a second degree freedom of movement. Moreover, printhead 50 is capable of moving, by means of ball-in-socket joint 210, in the path traveled by lune 215 to define at least a third degree freedom of movement. In fact, an inspection of FIG. 2 shows that printhead 50 in fact obtains five degrees of freedom of movement as follows: (1) rotable base 180 rotates printhead 50 horizontally in a 360° circle; (2) telescoping arm 200 moves printhead 50 vertically; (3) ball-in-socket joint 210 moves printhead 50 horizontally in a 360° circle; and (4) ball-in-socket joint 210 moves printhead 50 vertically in a 360° circle; and (5) second carriage 197 moves printhead 50 horizontally along beam member 190. It is important that printhead 50 have at least three degrees freedom of movement. This is important in order to provide printhead 50 access to substantially any portion of surface 30 for marking substantially any portion of surface 30.

Referring again to FIGS. 1, 2, 3 and 4, it may be appreciated that sensor 60 obtains two degrees freedom of movement relative to surface 30. That is, sensor 60 is capable of moving around object 40 in a 360° circle to define a first degree freedom of movement because sensor 60 is connected to leg 170, which in turn is connected to rotatable base 180. As previously mentioned, base 180 moves leg 170 in the 360° circle around object 40. In addition, sensor 60 is capable of moving in a direction along first axis 175 to define a second degree freedom of movement for sensor 60. It is important that sensor have at least two degrees freedom of movement. This is important to allow sensor 60 sufficient access to portions of surface 30 to be mapped by sensor 60 in the manner described hereinbelow.

Still referring to FIGS. 1, 2, 3 and 4, a controller 220 is connected to printhead 50, sensor 60 and positioning mechanism 160 for controlling positioning of printhead 50 and sensor 60. With respect to controlling positioning of printhead 50, controller 220 is connected to second carriage 197, such as by means of a first cable 230, for activating second carriage 197, so that second carriage 197 controllably slides along beam member 190. As controller 220 activates carriage 197, controller 220 may also controllably activate arm 200 for telescoping printhead 50 along third axis 205 to a predetermined constant distance from surface 30. Further, as controller 220 activates arm 200, controller 220 may also controllably activate ball-on-socket joint 210, by means of the previously mentioned linkage (not shown), for moving printhead 50 in the path traveled by lune 215. Of course, a reservoir 260 is connected to printhead 50 for supplying the marking medium (e.g., colored ink) to printhead 50.

Again referring to FIGS. 1, 2, 3 and 4, in order to control positioning of sensor 60, controller 220 is connected to first carriage 195, such as by means of a second cable 240, for activating first carriage 195, so that first carriage 195 controllably slides along leg 170. Moreover, controller 220 is connected to base 180 for controlling rotation of base 180. More specifically, controller 220 is connected to base 180, such as by means of a third cable 250, for activating base 180, so that base 180 controllably rotates in the previously mentioned 360° circle around support platform 45 and thus around object 40. Moreover, controller 220 performs yet other functions. As described in detail hereinbelow, controller 220 stores image 20 therein, actuates sensor 60 to allow mapping contoured surface 30 as sensor travels about surface 30, and activates printhead 50 to apply image 20 to surface 30 according to the map of surface 30 stored in controller 220.

Therefore, referring to FIGS. 1, 2, 3, 4, 6 and 7, the manner in which surface 30 is mapped into x, y and z Cartesian coordinates will now be described. First, object 40 is placed upon platform surface 45 by an operator of apparatus 10 as at Step 270. Either the operator or controller 220 then orients sensor 60 in the direction of object 40 as at Step 280. Next, controller 220 activates sensor 60 such that distance from sensor 60 of an initial point on surface 30 is determined as at Step 290. That is, sensor 60 effectively determines distance or proximity of object 40 from sensor 60. Distance of this initial point is determined either by use of light beams 80/90, sound waves 120/130 or follower 150. This initial point is designated as a datum point "0" and will have Cartesian coordinates of x=0, y=0 and z=distance from sensor 60 as at Step 300. These x, y and z coordinates for datum point "0" are then transmitted by second cable 240 to controller 220 and stored therein as at Step 310. Controller 220 then activates first carriage and/or base 180 to increment sensor 60 a predetermined amount in order to sense a first measurement point "1" on surface 30 as at Step 320. This first measurement point "1" is located at an epsilon distance "δ" on surface 30 in a predetermined direction from datum point "0" as at Step 330. Moreover, this first measurement point "1" will have coordinates of $x=x_1$, $y=y_1$ and $z=z_1$, where the values of $x_1$, $y_1$ and $z_1$ are distances defining location of measurement point "1" from datum point "0" in the well-known three-dimensional Cartesian coordinate system as illustrated by Step 340. The coordinates of measurement point "1" are then transmitted by second cable 240 to controller 220 and stored therein as at Step 350. Controller 220 then activates first carriage and/or base 180 to increment sensor 60 epsilon distance "δ" to a second measurement point "2" on surface 30 as at Step 360. That is, this second measurement point "2" is located at the epsilon distance "δ" on surface 30 in a predetermined direction from first measurement point "1" as illustrated by Step 370. Moreover, this second measurement point "2" will have coordinates of $x=x_2$, $y=y_2$ and $z=z_2$, where the values of $x_2$, $y_2$ and $z_2$ are distances defining separation of measurement point "2" from datum point "0" in the three-dimensional Cartesian coordinate system as illustrated by Step 380. These coordinates of second measurement point "2" are then transmitted by second cable 240 to controller 220 and stored therein as at Step 390. In similar manner, controller 220 activates first carriage and/or base 180 to increment sensor 60 by increments equal to epsilon distance "δ" about the entire surface 30 to establish values of $x=0, 1, \ldots n_x$; $y=0, 1, \ldots n_y$; and $z=0, 2, \ldots n_z$, where $n_x$, $n_y$ and $n_z$ equal the total number of measurement points to be taken on surface 30 in the x, y and z directions, respectively as at Step 400. Each measurement point is spaced-apart from its neighbor by epsilon distance "δ" as illustrated by Step 410. In this manner, all measurement points describing surface 30 are defined relative to initial datum point "0", which is defined by x=0, y=0 and z=distance from sensor 60 as illustrated by Step 420. The process disclosed hereinabove results in a three-dimensional grid map of contoured surface 30 being stored in controller 220 as x, y and z coordinates as at Steps 430, 440 and 450.

Referring again to FIGS. 1, 2, 3 and 4, controller 220 performs a calculation which justifies image 20 stored therein with the x, y and z map of surface 30 as at Step 460. Preferably image 20 has been previously stored in controller 220 and represented therein in the form of a plurality of points defined by x' and y' two-dimensional Cartesian coordinates. That is, each point in image 20 stored in controller 220 has been previously assigned x' and y' values representing image 20 in an x'-y' two-dimensional plane. This x'-y' plane has an origin defined by values of x'=0 and y'=0. The values in the x'-y' plane range from $x'=0, 1, 2, \ldots n_{x'}$, and from $y'=0, 1, 2, \ldots n_{y'}$, where $n_{x'}$ and $n_{y'}$ equal the total number of pixel points representing image 20 in the x' and y' directions, respectively. Controller 220 then mathematically operates on the values defining the x'-y' plane of image 20 in order to justify the x' and y' values forming image 20 to the x and y measurement values forming the map of surface 30. That is, controller 220 multiplies each x' and y' value by a predetermined scaling factor, so that each x' and y' value is respectively transformed into corresponding x" and y" values as at Step 470. The z coordinates of the measurement values obtained by sensor 60 remain undisturbed by this justification. That is, after controller 220 scales the x' and y' values, controller 220 generates corresponding x" and y" values (with the z coordinate values remaining undisturbed). The x" values range from $x''=0, 1, 2, \ldots n_{x''}$ and the y" values range from $y''=0, 1, 2, \ldots n_{y''}$, where $n_{x''}$ and $n_{y''}$ equal the total of pixel points representing image 20 in the x" and y" directions, respectively as illustrated by Step 480. It should be understood from the description hereinabove, that once the values of x" and y" are defined, the values of z are predetermined because there is a unique value of z corresponding to each x" and y" pair as illustrated by Step 490. These values of x", y" and z define where ink pixels are to be applied on surface 30 as illustrated by Step 500. As described hereinbelow, after the map and image 20 stored in controller 220 are justified, controller 220 controls printhead 50 and positioning mechanism 160 to print the now justified image 20 on surface 30. If desired, the position of a significant portion (e.g., the nose on a bust statue) of image 20 in the x-y plane stored in controller 220 may be matched to the corresponding significant portion of object 40 stored in the x'-y' plane in order to obtain the necessary justification.

Again referring to FIGS. 1, 2, 3 and 4, controller 220 transmits a signal to second carriage 197, arm 200, ball-in-socket joint 210 and/or base 180 to position printhead 50 at the first pixel point to be printed. This first pixel point is located on surface 30 at a location defined by x"=1, y"=1 and the z value uniquely associated therewith. That is, once x"=1 and y"=1 are defined, the value of z corresponding to the pair of values for x"=1 and y"=1 is predetermined. Next, controller 220 activates printhead 50 to expel ink at the location on surface 30 corresponding to x"=1, y"=1 and the associated z value in order to mark surface 30 thereat. If desired, the z value is scaled such that printhead 50 is always spaced a predetermined distance from surface 30 in order to uniformly apply ink to surface 30. The process described hereinabove is repeated until all of image 20 is marked on surface 30.

Figure 5:
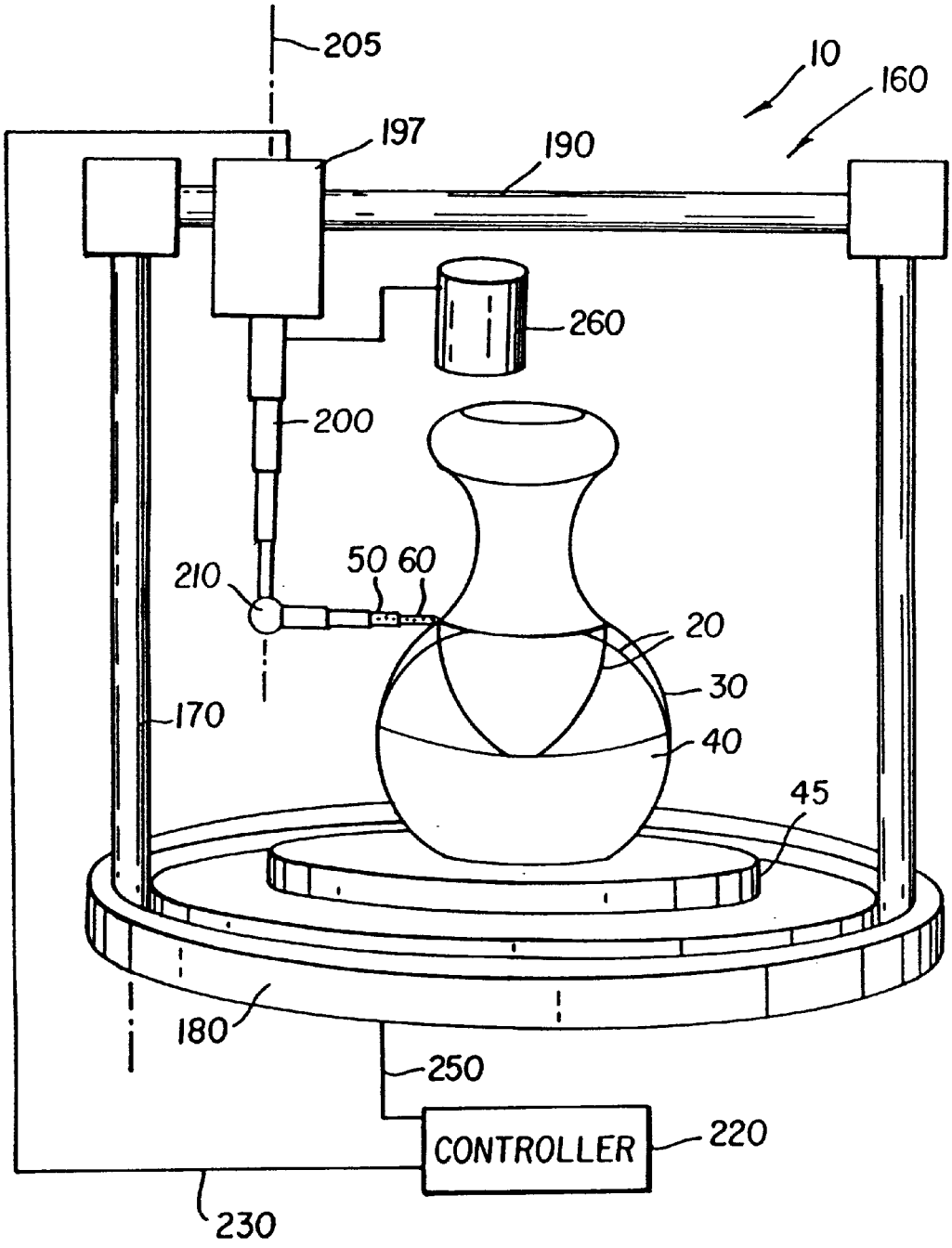
FIG. 5 is a view in elevation of an alternative embodiment of the invention.
Figure 6A:
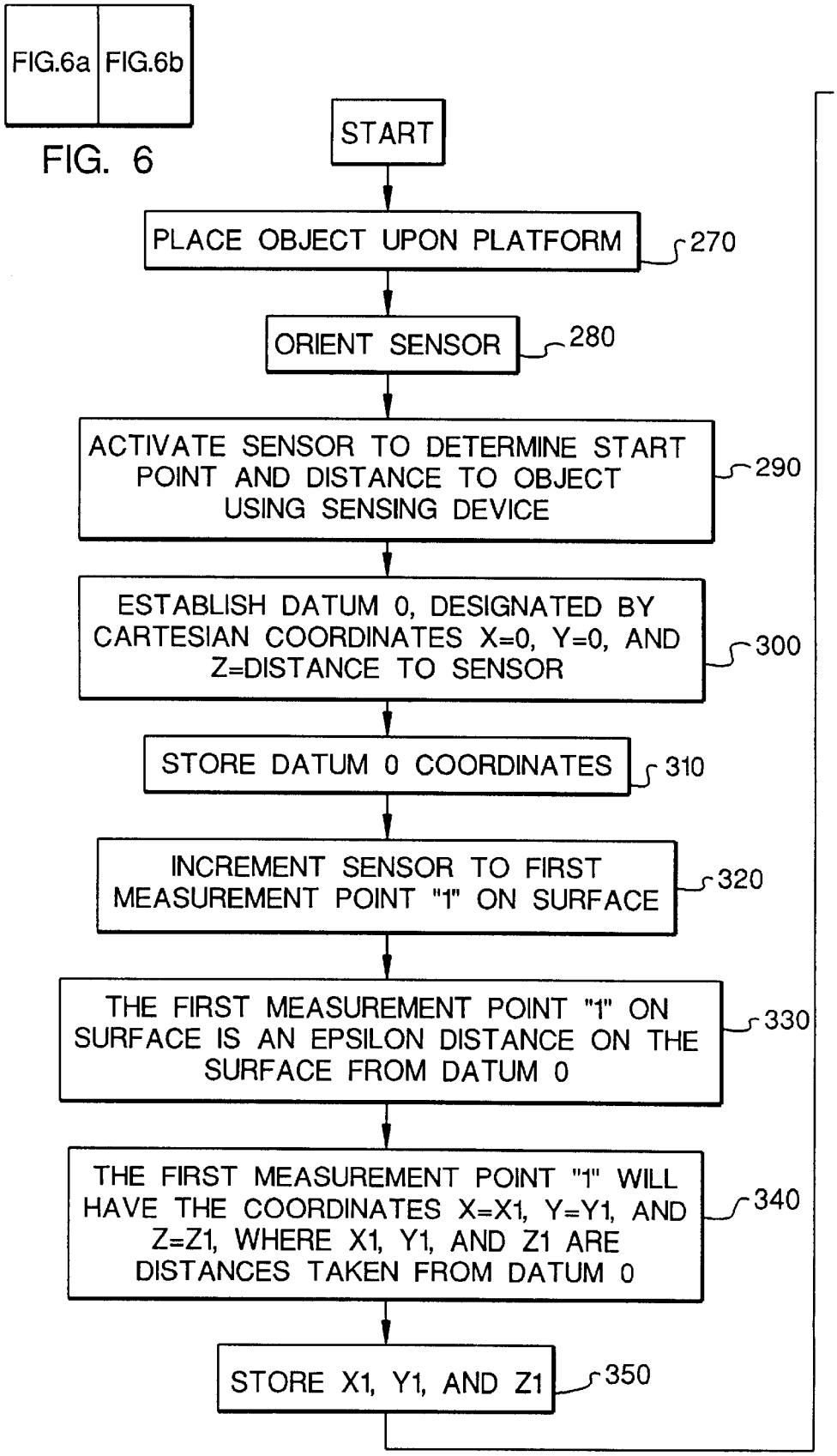
FIG. 6 displays a logic flowchart of a process for mapping an image onto the surface.
Figure 6B:
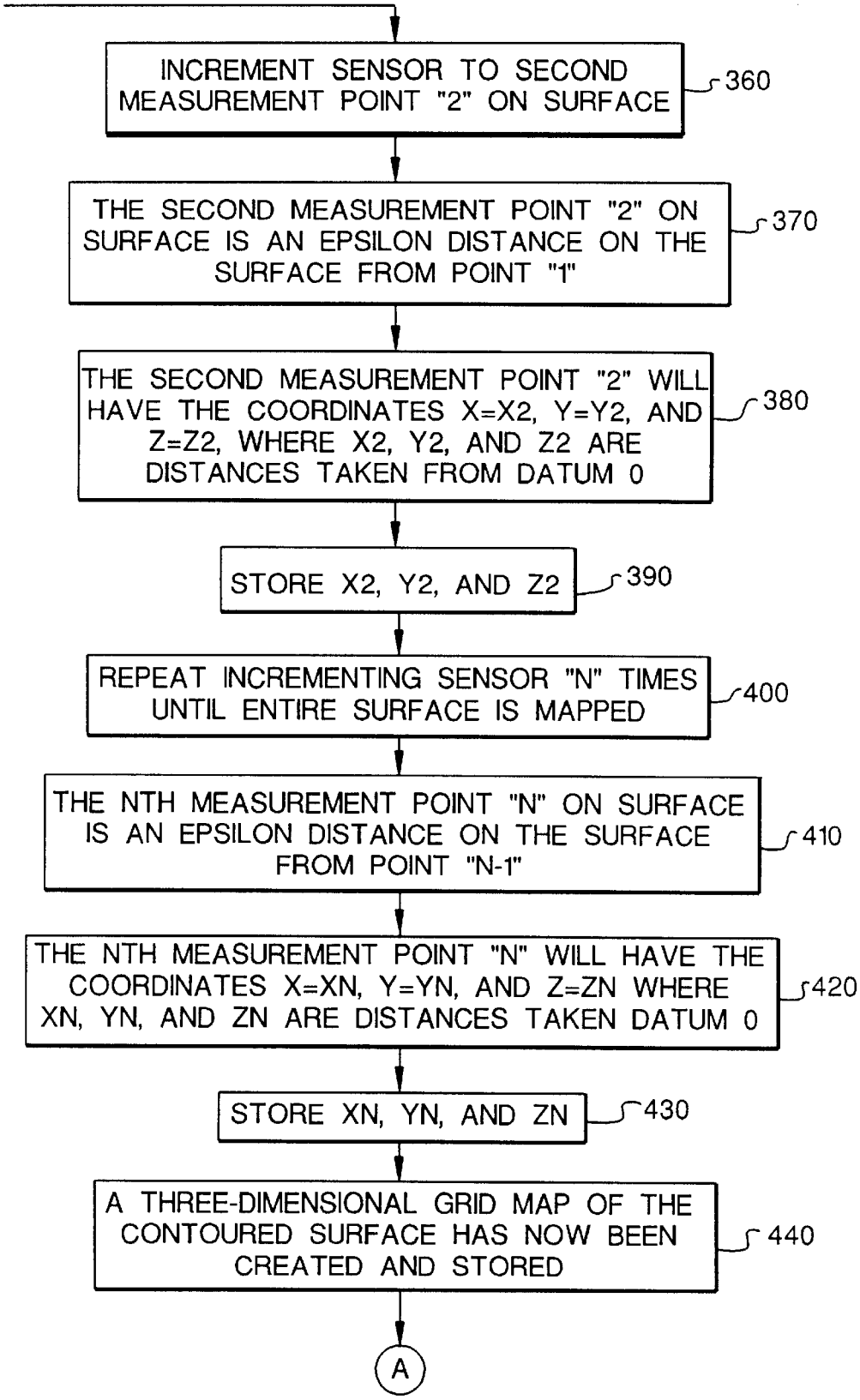
Figure 7:
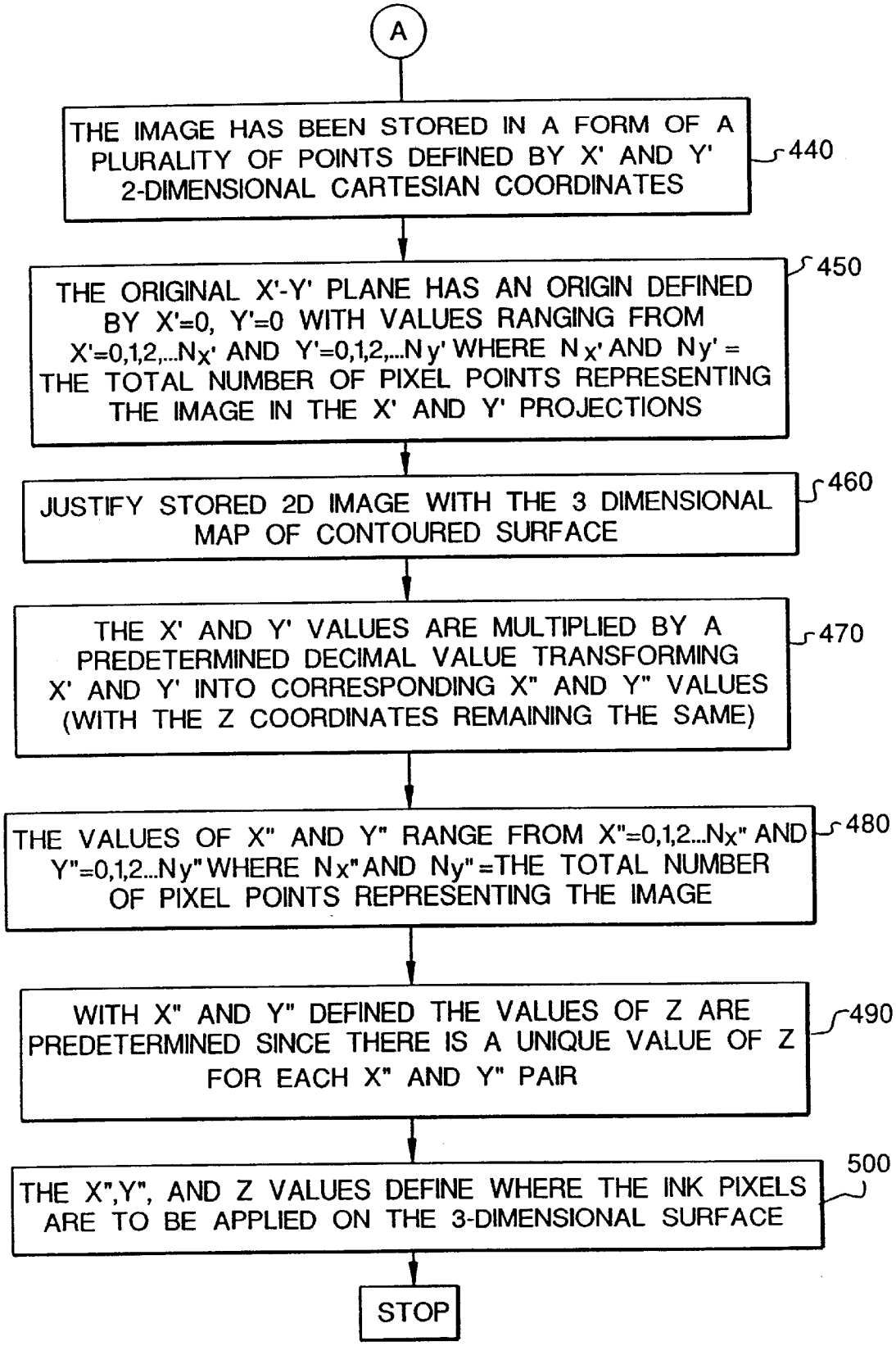
FIG. 7 is a continuation of the logic flowchart begun in FIG. 6.

As best seen in FIG. 5, an alternative embodiment of the present invention is there shown for marking contoured surface 30. In this alternative embodiment of the invention, printhead 50 and sensor 60 are combined into one assembly. This alternative embodiment of the invention eliminates need for first carriage 195 and second cable 240. Instructions to both printhead 50 and sensor 60 are transmitted thereto from controller 220 over first cable 230. Moreover, this alternative embodiment of the invention allows sensor 60 to have the same number of degrees of freedom (i.e., at least three degrees of freedom) as printhead 50. This results in an increased number of degrees of freedom of movement for sensor 60 compared to the first embodiment of the invention. This is particularly useful to facilitate measurement of surfaces which are largely perpendicular to third axis 205.

It may be appreciated from the teachings herein that an advantage of the present invention is that marking medium is precisely applied evenly on predetermined portions of surface 30 in a time-saving manner. This is so because the automatic control provided by controller 220 allows printhead 50 to be spaced a constant distance from surface 30 by means of precise movement of positioning mechanism 160 and also allows the speed of the marking process to be increased compared to the manual marking technique.

While the invention has been described with particular reference to its preferred embodiments, it is understood by those skilled in the art that various changes may be made and equivalents may be substituted for elements of the preferred embodiments without departing from the invention. For example, apparatus 10 is disclosed herein as applying ink on surface 30 to create a printed image; however, apparatus 10 may be modified to abrade predetermined portions of surface 30 to create an image in relief. As another example, apparatus 10 may be modified to apply a glaze or other protective coating to predetermined portions of surface 30. As yet another example, support platform 45 may be suitably rotated rather than base 180. As still another example, support platform 45 may be movable vertically. Also, although the Cartesian coordinate system is used to map surface 30, the Polar coordinate system may be used instead. As a further example, inkjet printhead 50 may be replaced by a suitable brush.

As is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is an apparatus and method for marking a contoured surface having a complex topology.

Parts List

10 . . . apparatus
20 . . . image
30 . . . surface
40 . . . object
45 . . . support platform
50 . . . marker
60 . . . sensor
70 . . . light source
80 . . . light beam
90 . . . reflected light beam
100 . . . light detector
110 . . . sonic transducer
120 . . . sound wave
130 . . . reflected sound wave
140 . . . sound detector
150 . . . follower
155 . . . end portion of follower
160 . . . positioning mechanism
170 . . . leg
175 . . . first axis
180 . . . base
190 . . . beam member
192 . . . second axis
195 . . . first carriage
197 . . . second carriage
200 . . . telescoping arm
205 . . . third axis
210 . . . ball-in-socket joint
215 . . . lune
220 . . . controller
230 . . . first cable
240 . . . second cable
250 . . . third cable
260 . . . reservoir
270–500 . . . generalized process steps

What is claimed is:

1. An apparatus for printing an image on a contoured surface having a complex topography, the image to be printed being represented by first image data, the apparatus comprising:

(a) a movable ink marker for marking the surface;

(b) a sensor disposed in sensing relationship to the surface for sensing contour of the surface;

(c) a controller that is programmed to operate said sensor to map the surface prior to commencement of printing and then to derive adjusted image data of the first image data in accordance with the sensing of contour of the surface and then to control printing signals to the marker in accordance with the adjusted image data.

2. The apparatus of claim 1 wherein the ink marker is supported by a pivotable connection to permit rotation of the marker and the pivotable connection is connected to a member that provides linear movement of the marker and wherein the marker is spaced from the surface during printing of the image.

3. The apparatus of claim 2 wherein said marker comprises an inkjet printhead.

4. The apparatus of claim 1 wherein said marker is supported by a support that supports the marker for five degrees of freedom.

5. The apparatus of claim 1 wherein said sensor comprises:

(a) a light source for emitting a light beam to be intercepted by the surface and reflected therefrom to define a reflected light beam; and (b) a light beam detector associated with said light source for detecting the reflected light beam.

6. The apparatus of claim 1 wherein said first image data represents a two-dimensional image and said controller is programmed to convert the two-dimensional image into the adjusted image data that represents an adjustment for the contour of the surface measured.

7. The apparatus of claim 6 wherein said marker comprises an inkjet printhead.

8. The apparatus of claim 7 wherein said marker is supported by a support that supports the marker for five degrees of freedom.

9. A method for printing an image on a contoured surface having a complex topography, the method comprising:

providing first image data of an image to be printed on the surface;

sensing the contour of the surface;

forming adjusted image data of the image to be printed in response to sensing of the contour; and printing the image with the adjusted image data.

10. The method according to claim 9 wherein printing is made by an inkjet printhead that is maintained at a fixed distance from the surface.

11. The method according to claim 9 wherein printing is made by an inkjet printhead whose orientation relative to a point being printed on the surface is different then when printing other points on the surface.

12. The method according to claim 11 wherein the inkjet printhead is moved with five degrees of freedom during printing of the image on the surface.

13. The method according to claim 11 wherein the inkjet printhead is pivoted and translated as it is moved relative to the surface.

14. The method according to claim 9 wherein the first image to be printed is defined as two-dimensional image data.

* * * * *